US006997331B2

(12) United States Patent
Lobe

(10) Patent No.: US 6,997,331 B2
(45) Date of Patent: Feb. 14, 2006

(54) WHEEL SPACER APPARATUS AND METHOD OF USING WHEEL SPACER

(76) Inventor: William C. Lobe, 182 Boblink La., Brandenburg, KY (US) 40108

( * ) Notice: Subject to any disclaimer, the term of this patent is extended or adjusted under 35 U.S.C. 154(b) by 120 days.

(21) Appl. No.: 10/417,057

(22) Filed: Apr. 16, 2003

(65) Prior Publication Data

US 2005/0016942 A1 Jan. 27, 2005

Related U.S. Application Data

(60) Provisional application No. 60/375,993, filed on Apr. 29, 2002.

(51) Int. Cl.
*A47F 7/00* (2006.01)

(52) U.S. Cl. ..... 211/59.4

(58) Field of Classification Search ..... 211/59.4, 211/191, 23; D/34, 38; 206/303, 386; 108/53.1
See application file for complete search history.

(56) References Cited

U.S. PATENT DOCUMENTS 3,934,789 A * 1/1976 Allman et al. ..... 229/407
4,195,732 A * 4/1980 Bell ..... 206/391
D256,346 S 8/1980 Annis
D264,067 S 4/1982 Nordstrom
D264,323 S 5/1982 Nordstrom
4,580,680 A 4/1986 Wind
5,295,445 A 3/1994 Locke et al.
5,425,521 A * 6/1995 Locke ..... 248/346.02
5,513,750 A 5/1996 Rychel
5,749,475 A 5/1998 Krebs
5,752,608 A 5/1998 Dingeldein
5,887,718 A 3/1999 Oslin et al.
6,379,107 B1 4/2002 Iwasaki et al.
6,484,877 B1 * 11/2002 Murakami et al. ..... 206/303

* cited by examiner

*Primary Examiner*—Sarah Purol
(74) *Attorney, Agent, or Firm*—James E. Cole; Middleton Reutlinger

(57) ABSTRACT

A wheel spacer having a boundary wall being substantially rectangular in shape. The boundary wall is defined by first and second longitudinal walls and first and second latitudinal walls. Extending between the longitudinal walls are a plurality of load bearing members having a chamfered top and bottom surface. The load bearing members are spaced in cooperating pairs each providing a space for a row of wheels. Extending between cooperating pairs of load bearing members are load bearing cross-members and extending between non-cooperating pairs of load bearing members are connecting support members.

23 Claims, 4 Drawing Sheets

WHEEL SPACER APPARATUS AND METHOD OF USING WHEEL SPACER

CROSS-REFERENCE TO PRIOR APPLICATIONS

This application claims priority to U.S. Provisional Patent Application 60/375,993, filed on Apr. 29, 2002, which is incorporated herein by reference.

BACKGROUND OF THE INVENTION

1. Field of the Invention

The present invention relates to a wheel spacer apparatus. More specifically, the present apparatus provides a wheel spacer apparatus for spacing and stacking vehicle wheels during manufacturing, transport, and storage and while inhibiting damage of the wheel finish.

2. Description of the Related Art

A variety of devices are used in order to move wheels through a manufacturing process, store vehicle wheels at manufacturing facilities, transport the wheels from the wheel manufacturer to an automobile manufacturing facility, and store the wheels at the vehicle manufacturing facility until the wheels are needed during vehicle manufacture. Many of these devices are referred to as "trays" or "dividers" and are formed of wood in a substantially planar configuration. The wood spacers presently used are positioned between rows of vehicle wheels such that a pallet is positioned at ground level, a first spacer is positioned on top of the pallet, a first at least two rows of wheels on top of the first spacer, a second spacer on top of the at least two rows of wheels, a second at least two rows of wheels on top the second spacer, and so on until the wheels are stacked to a desirable height for storage and transportation.

However, wooden spacer devices have a plurality of operating disadvantages. Wooden spacers crack, break, and splinter creating dust and wood debris which may contact a wheel surface before painting or plating and therefore may cause surface defects and reject wheels. Wood spacers which splinter become unusable and are also prone to cause injury to workers using the spacers. Another problem with wooden spacers is that the wood collects or absorbs water resulting in warped spacers and in turn resulting in unstable wheel stacks. The wet wood also breaks and chips easily resulting in wheel to wheel contact which may damage a wheel finish. Another problem with the use of wood is that the weight of the wood is such that the wood spacers can each weigh about 25 pounds.

In view of known deficiencies associated with existing wood spacers, a spacer is needed having good strength characteristics, inhibiting bowing even when wet, which drains water, weighing less than comparably sized wooden spacers, may be used with various wheel sizes, and inhibits the spread of dust and debris.

SUMMARY OF THE INVENTION

The present invention provides a wheel spacer apparatus which seeks to avoid those and other deficiencies and problems found in currently known wheel spacers. According to a present embodiment, a wheel spacer is described below with reference to the accompanying drawings wherein an object of the present invention is to inhibit dust and debris from contaminating the finish of the wheels spaced apart by the wheel spacer.

Another object of the present invention is to provide a wheel spacer weighing less than currently known wheel spacers.

Yet an even further object of the present invention is to provide wheel spacer which will not warp when wet and does not retain water but and other fluids instead freely drains.

Still an even further object of the present invention is to provide a wheel spacer which may be used with wheels of various size.

Specifically, a wheel spacer is provided formed of a polymeric material, for example an injection molded thermoplastic resin, and defined by a unitary construction. The wheel spacer may be formed by an injection molding process of polypropylene and may include organic or inorganic fibers such as for example fiberglass. In one exemplary embodiment, the material forming the wheel spacer may be 10% (percent) fiberglass reinforced polypropylene. In an exemplary embodiment, the wheel spacer functions to hold vehicle wheels in a vertical arrangement during manufacture, storage, and in transit in order to inhibit damage to the wheel finish. For purpose of this application, a vertical arrangement may be defined wherein the wheel is oriented as if it were mounted on a vehicle. Accordingly, the wheel spacer comprises a boundary wall forming a substantially rectangular shape. The boundary wall may have at least one pair of longitudinal walls and at least one pair of latitudinal walls. Each boundary wall may be formed of a first side portion and a second side portion connected by a plurality of ribs. The boundary walls may also have rectangular shaped sections and hyperbolic shaped sections which both reduce the weight of the spacer and provide rigidity. Within the boundary walls are a plurality of load bearing members extending between said first and second longitudinal walls. According to one exemplary embodiment, the load bearing members are substantially rectangular in section and may be defined by a first side portion and a second side portion each connected by a plurality of ribs. The load bearing members may be arranged in cooperating pairs in order to support the outer rim portion of a wheel. In one embodiment the upper surface of each of the load bearing members may be chamfered in order to provide a seat for a wheel or otherwise inhibit rocking of a wheel placed therein.

Extending between each of the load bearing members defining a cooperating pair are hyperbolically shaped load bearing cross-members. The load bearing cross-members are formed of first and second side portions connected by a plurality of ribs extending therebetween in a spaced arrangement. The load bearing cross-members extend substantially parallel to the longitudinal members and substantially perpendicular to the load bearing members.

Extending from one cooperating pair of load bearing members to a second cooperating pair of load bearing members are a plurality of connecting support members. The connecting support members provide rigidity, inhibit bowing, and may be formed from a first side portion and a second side portion having a plurality of ribs extending therebetween in a spaced configuration. The connecting support members may also be hyperbolic in shape in order to reduce the weight of the spacer yet provide a rigid structure. In addition, the connecting support members may also extend from the load bearing members to the latitudinal walls of the boundary walls.

All of the above outlined objectives are to be understood as exemplary only and many more objectives of the invention may be gleaned from the disclosure herein. Therefore, no limiting interpretations of the objectives noted are to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 3:
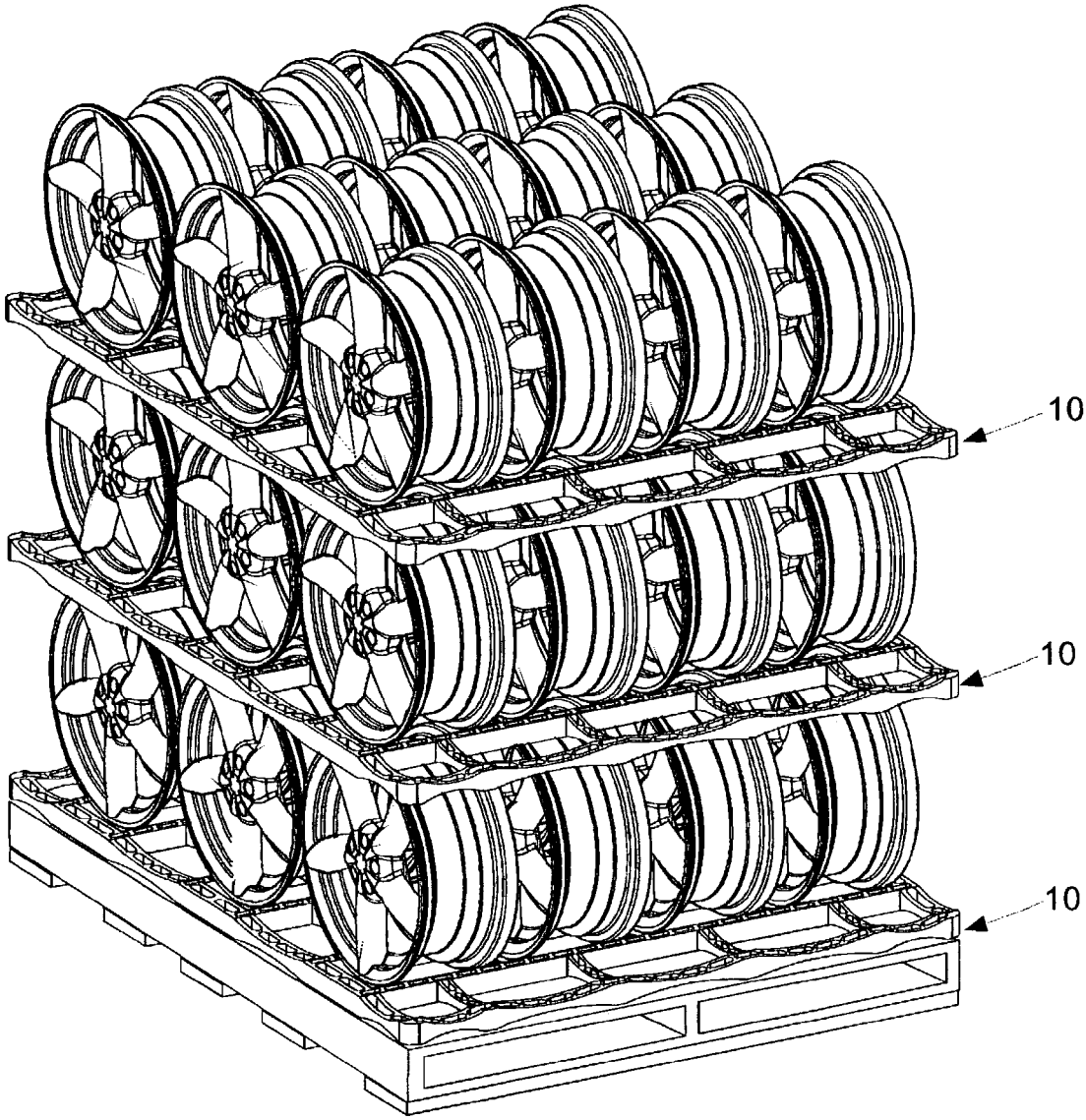
FIG. 3 depicts a side perspective view of a plurality of wheel spacers of FIG. 1 having automobile wheels stored therebetween.

The invention provides a wheel spacer apparatus 10 for storing and transporting vehicle wheels as shown in FIG. 3. In a preferred embodiment of the present invention the wheel spacer 10 design comprises a polymeric structure which may be used to transport and store wheels for automobiles while preventing the wheel finish from being damaged. The wheel spacer or shipping pallet 10 provided comprises a unitary construction having a generally planar design. The wheels are in vertical arrangement, as shown in FIG. 3, such that a major axis of the vehicle wheels are substantially horizontal and each of the outer wheel rims contact the wheel spacer 10 at four locations.

Figure 1:
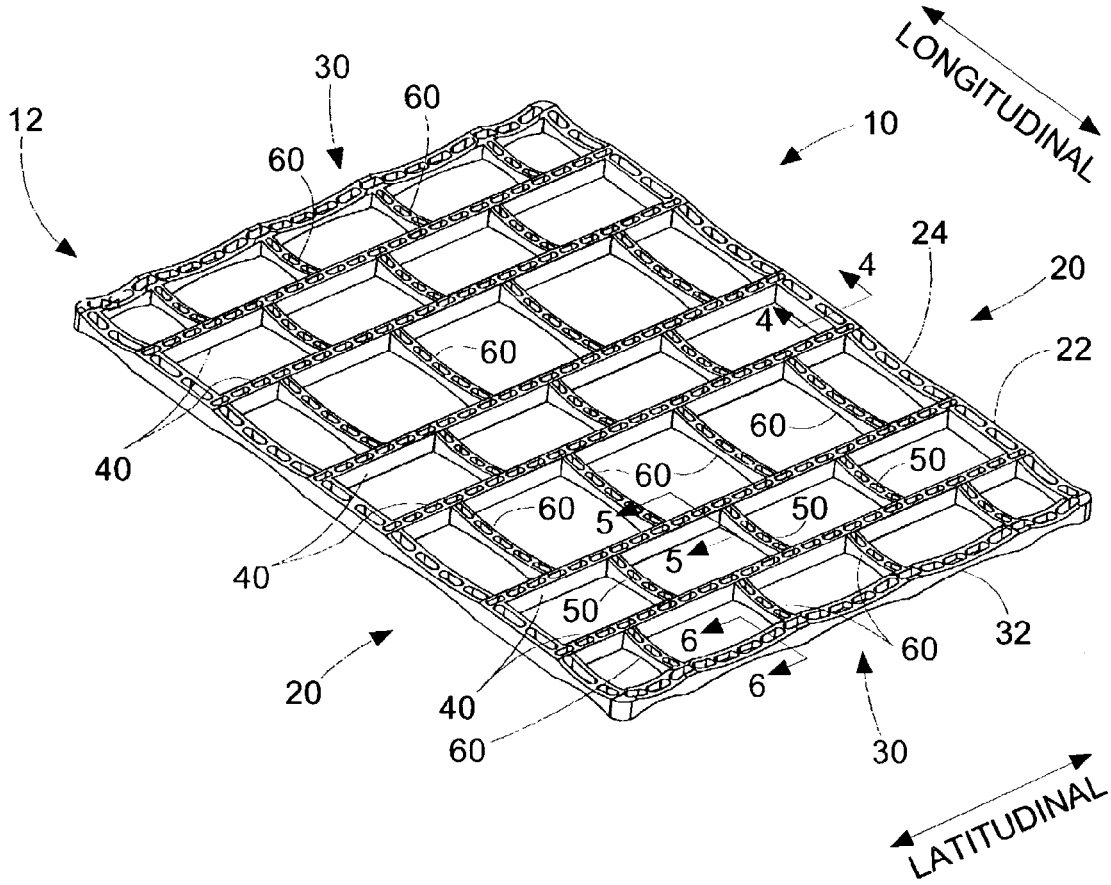
FIG. 1 depicts a perspective view of a wheel spacer of the present invention.
Figure 2:
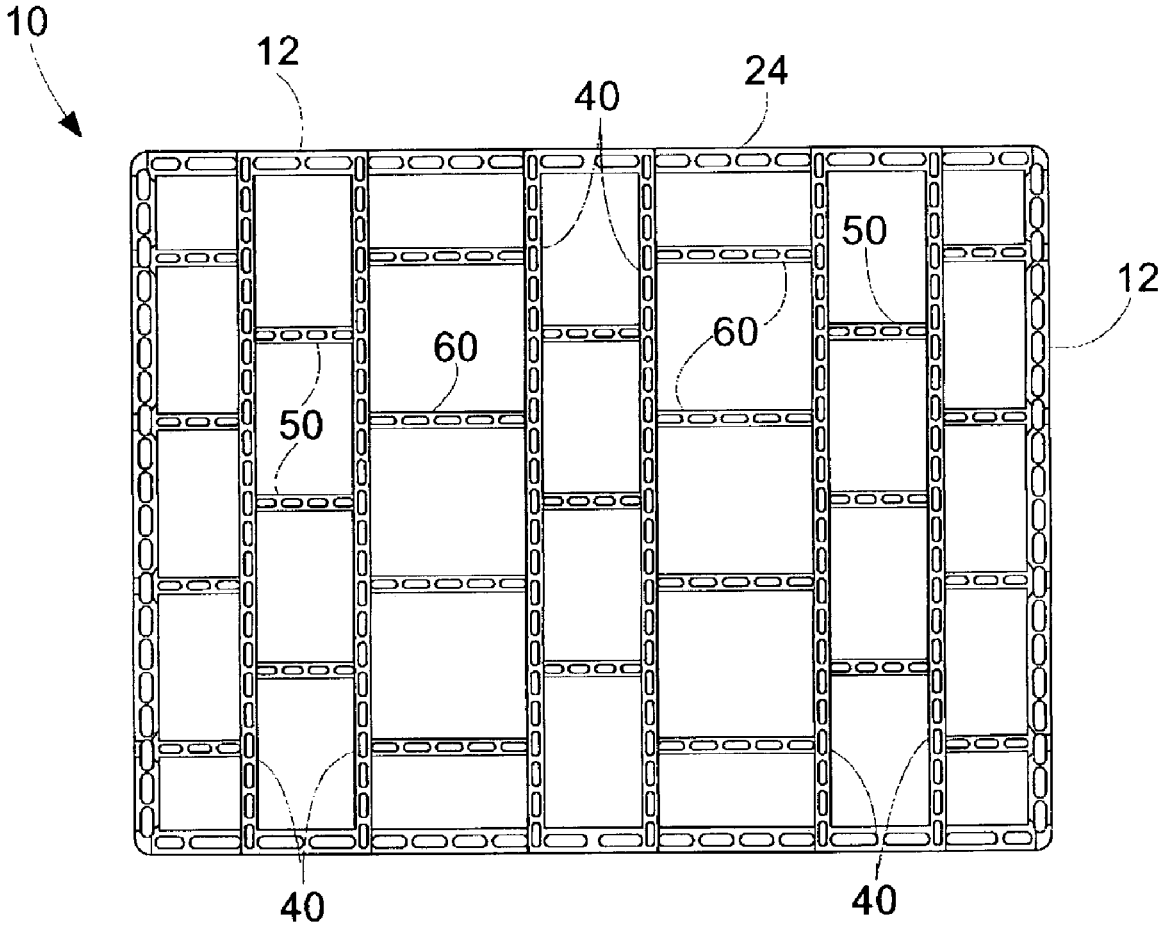
FIG. 2 depicts a top view of the wheel spacer of FIG. 1.

Referring initially to FIGS. 1 & 2, a wheel spacer 10 of the present invention is provided. The wheel spacer 10 may be formed of a plurality of materials including, for example, an injection molded thermoplastic, for example, such as a polymeric material. According to one exemplary embodiment the polymeric material may be polypropylene and more specifically 10% fiberglass reinforced polypropylene. The polymeric material provides a structure which will not create dust and other debris over repeated cycles of use. In addition, the polymeric material will not absorb water or other fluids which are prevalent in manufacturing facilities and therefore the spacer 10 will not warp. However, various other materials may be used which provide excellent tensile and impact properties.

Figure 4:
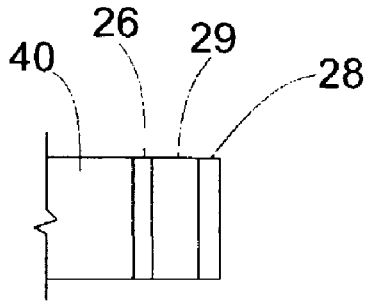
FIG. 4 depicts a sectional view of a longitudinal wall of the wheel spacer of FIG. 1.

The instant wheel spacer 10 comprises a boundary wall 12 having a substantially rectangular geometric configuration. The rectangular shape however, is merely exemplary as various other shapes may be used to form the wheel spacer 10, including square, for instance. The boundary wall 12 is formed of first and second parallel longitudinal walls 20 and first and second latitudinal walls 30. As shown in FIG. 4, the longitudinal walls 20 are each comprised of a first side portion 26, a second side portion 28, and a rib portion 29 extending between the first and second side portions 26,28 in a spaced configuration. This double-wall design provides strength to withstand the large loads of several rows of wheels while the ladder style ribs 29 provide strength for the longitudinal wall 20 and also define a plurality of weight saving apertures. The ladder style rib configuration also provides an advantage of allowing fluid drainage and minimizing dust collection surfaces. The first and second side portions 26,28 and rib portion 29 may have various thicknesses and according to one embodiment are about ¼" thick. This provides adequate strength while allowing for faster molding time than larger thicknesses. The longitudinal walls 20 are formed of alternating hyperbolic shaped portions 24 and rectangular portions 22. The rectangular portions 22 are preferably provided between cooperative pairs of load bearing members 40 where additional strength is needed for larger loads. The hyperbolic shaped portions 24 are preferably provided to reduce weight where smaller loads are present and less structural strength is needed.

The boundary wall 12 also comprises first and second parallel latitudinal walls 30. The latitudinal walls 30 include first and second side portions 36,32 connected by a plurality of ribs 39 extending therebetween in a spaced arrangement. The ribs 39 define a plurality of weight saving apertures in the latitudinal walls 30 yet still provide strength and rigidity.

Figure 5:
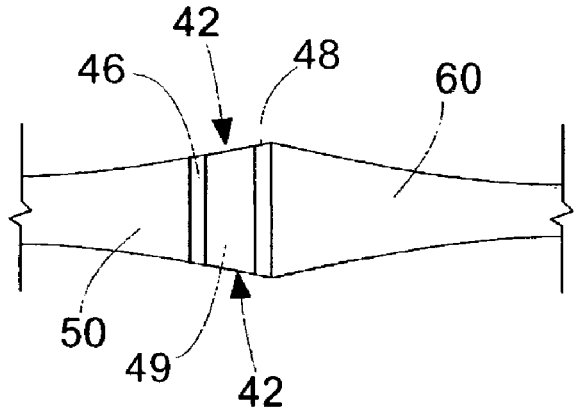
FIG. 5 depicts a sectional view of a load bearing member of the wheel spacer of FIG. 1; and, FIG. 6 depicts a sectional view of a latitudinal wall of FIG. 1.

Extending perpendicular to and between the longitudinal walls 20 and parallel to the latitudinal walls 30 are a plurality of load bearing members 40. As shown in FIG. 1, the load bearing members 40 are substantially rectangular in shape and, as shown in FIG. 5, include a first side portion 46, a second side portion 48, and a plurality of ribs 49 extending between the first and second side sections in order to provide rigidity to the structure. The load bearing members 40 have chamfered surfaces 42 in order to provide a seat for a wheel or to inhibit rocking of a vertically positioned wheel. The chamfer 42 may be sized to accommodate wheels of varying diameter and is located on upper and lower surfaces allowing for the stacking ability shown in FIG. 3.

The load bearing members 40 are arranged in cooperating pairs. For purpose of this description, cooperating pairs means that when a wheel is placed on a wheel spacer 10, the wheel will contact two load bearing members 40, those two members being cooperating members. In one exemplary embodiment, there are three cooperating pairs of load bearing members 40 wherein a single row of wheels may be placed between each cooperating pair of load bearing members. However, various load bearing members may be included to form any number of cooperating pairs of load bearing members.

Extending between the cooperating pairs of load bearing members 40 are a plurality of load bearing cross-members 50. The cross-members 50 extend substantially perpendicular to the load bearing members 40 and are substantially hyperbolic in shape. The hyperbolic shape inhibits interference of the load bearing cross-member 50 with the profile of the wheel placed therein. In combination the load bearing cross-members 50 and load bearing members 40 form a substantially H-shaped wheel tray as shown in FIG. 2. The load bearing cross-members 50 are each comprised of a first side portion, a second side portion, and a plurality of ribs extending between the first and second side portions. This design, as previously described, provides the rigidity to handle large loads yet also provides a light weight design.

Figure 6:
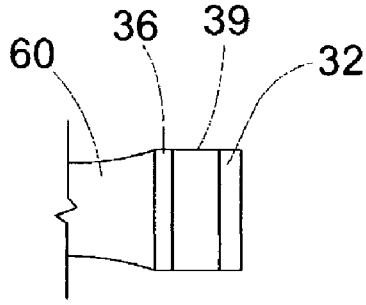

Extending from a load bearing member 40 of a first cooperating pair to a load bearing member 40 of a second cooperating pair are a plurality of connecting support members 60. Alternatively stated the connecting support members 60 extend between non-cooperating load bearing members. As depicted in FIG. 3 the wheels are not supported by non-cooperating load bearing members 40, but are instead supported by cooperating load bearing members 40. The connecting support members 60 are substantially perpendicular to the load bearing members 40 and inhibit bowing of the load bearing members 40 when loaded. The connecting support members 60 comprise a first side portion, a second side portion, and a plurality of ribs extending between said first side portion and said second side portion in a spaced configuration similar to configurations shown in FIGS. 4 and 6. As shown in FIG. 5, the connecting support members 60 are substantially hyperbolic in shape in order to save weight yet provide a rigid structure and inhibit bowing of the load bearing members 40. The connecting support members 60 also extend between the load bearing members 40 and the latitudinal walls 30 in order to prevent bowing of the load bearing members 40 toward the latitudinal walls 30.

The structural design of the instant invention provides at least two advantages. First the instant design provides a weight saving arrangement. A wooden spacer of a comparable design and sized for use with an equal number of vehicle wheels may weigh approximately 25 pounds (Lbs.) whereas the wheel spacer 10 of the instant invention has a weight of about 17 pounds (Lbs.). A second advantage is that the upper surface and lower surface are symmetrical about the longitudinal axis so that the spacer 10 may be rotated about the longitudinal axis in either an upward or downward direction to provide spacing for rows of wheels. In other words, the top and bottom of surfaces spacer 10 are mirror images of one another. This design allows the spacer 10 to be positioned on top of a first row of wheels while being beneath a second row of wheels.

In use, as shown in FIG. 3, a spacer 10 may be positioned on a wooden pallet for ease of lifting, utilizing a forklift. At least two rows of wheels are stacked on the spacer 10 between cooperating pairs of load bearing members 40, and a second spacer 10 is positioned above the first at least two rows of wheels. A second at least two rows of wheels are placed on the second spacer 10 between cooperating pairs of load bearing members 40 and a third spacer 10 maybe placed on the second at least two rows of wheels.

The foregoing detailed description is given primarily for clearness of understanding and no unnecessary limitations are to be understood therefrom for modifications will become obvious those skilled in the art upon reading this disclosure and may be made without departing from the spirit of the invention and scope of the appended claims.

I claim:

1. A wheel spacer apparatus:

a. a substantially rectangular shaped boundary wall including a first longitudinal wall and a second longitudinal wall and a first latitudinal wall and a second latitudinal wall;

b. a plurality of load bearing members extending between said first and second longitudinal walls;

c. a plurality of load bearing cross-members extending between cooperating pairs of said load bearing members wherein said load bearing members have a chamfered upper and lower surface; and, d. a plurality of connecting support members extending between non-cooperating load bearing members.

2. The wheel spacer apparatus of claim 1, said load bearing members extending substantially perpendicular to said first and second longitudinal walls.

3. The wheel spacer apparatus of claim 1, said load bearing members extending substantially parallel to said first and second latitudinal walls.

4. The wheel spacer apparatus of claim 1, said load bearing cross-members extending substantially perpendicular between said load bearing members.

5. The wheel spacer apparatus of claim 1, said load bearing cross-members extending substantially parallel to said longitudinal walls.

6. The wheel spacer apparatus of claim 1, said connecting support members extending between latitudinal load bearing walls and said load bearing members.

7. The wheel spacer apparatus of claim 6, said connecting support members being a substantially hyperbolic in shape.

8. The wheel spacer apparatus of claim 1, said load bearing cross-members being substantially hyperbolic in shape.

9. The wheel spacer apparatus of claim 1, said load bearing members being substantially quadrilateral in shape.

10. The wheel spacer apparatus of claim 1, said longitudinal wall having hyperbolic shaped portions and rectangular portions sections.

11. The wheel spacer apparatus of claim 1, said apparatus formed of a polymeric material.

12. The wheel spacer apparatus of claim 11, said polymeric material comprising about 10 percent fiberglass reinforced polypropylene.

13. The wheel spacer apparatus of claim 1, said boundary wall, said load bearing members, said load bearing cross-members, and said connecting support members each formed of first and second side portions connected by at least one rib extending between said first side and said second side.

14. The wheel spacer apparatus of claim 1, said boundary wall, said load bearing members, said load bearing cross-members, and said connecting support members each having a double walled design and a ladder-style rib configuration.

15. A wheel spacer apparatus, comprising:

a. a substantially rectangular shaped boundary wall including a first longitudinal wall and a second longitudinal wall and a first latitudinal wall and a second latitudinal wall;

b. a plurality of cooperating pairs of load bearing members extending between said longitudinal walls;

c. a plurality of load bearing cross-members extending between said cooperating pairs of load bearing members wherein said load bearing members have opposed chamfered surfaces;

d. a plurality of connecting support members connecting non-cooperating load bearing members.

16. The wheel spacer apparatus of claim 15, said connecting support members connecting said boundary wall and load bearing members.

17. The wheel spacer apparatus of claim 15, said plurality of connecting support members being substantially hyperbolic in shape.

18. The wheel spacer apparatus of claim 15, said load bearing members being substantially rectangular in shape.

19. The wheel spacer apparatus of claim 15, said load bearing cross-members being substantially hyperbolic in shape.

20. The wheel spacer apparatus of claim 15, said longitudinal walls having hyperbolic portions and rectangular shaped sections.

21. The wheel spacer apparatus of claim 15, said load bearing members, said load bearing cross-members, said boundary walls, and said connecting support members each having a double walled design with a ladder style rib configuration.

22. The wheel spacer apparatus of claim 15, a top portion of said spacer being identical to a bottom portion of said spacer.

23. A wheel spacer apparatus, comprising:

a substantially rectangular boundary wall having a plurality of cooperating load bearing pairs extending between opposed walls of said boundary wall;

a plurality of hyperbolically shaped load bearing cross-members extending between load bearing members defining each of said cooperating pairs;

said load bearing members having opposed chamfered surfaces.

* * * * *